US006073272A

United States Patent [19]

Ball

[11] Patent Number: 6,073,272

[45] Date of Patent: Jun. 13, 2000

[54] HELMET WITH EAR PROTECTION AND A HEARING ENHANCEMENT FEATURE

[75] Inventor: Roger M. Ball, Toronto, Canada

[73] Assignee: Red Corp., Burlington, Vt.

[21] Appl. No.: 09/004,561

[22] Filed: Jan. 7, 1998

[51] Int. Cl.[7] ..... A42B 3/16

[52] U.S. Cl. ..... 2/423

[58] Field of Search ..... 2/410, 411, 423, 2/422, 425

[56] References Cited

U.S. PATENT DOCUMENTS

| | | | |
|---|---|---|---|
| 2,140,630 | 12/1938 | Illguth | 2/6 |
| 2,282,830 | 5/1942 | Scudder et al. | 2/422 |
| 3,239,842 | 3/1966 | Marchello | 2/423 |
| 3,471,865 | 10/1969 | Molitoris | 2/423 |
| 3,497,874 | 3/1970 | Molitoris | 2/423 |
| 3,500,475 | 3/1970 | Otsuka | 2/423 |
| 3,778,844 | 12/1973 | Hori et al. | 2/423 |
| 4,397,045 | 8/1983 | Schonwetter et al. | 2/5 |
| 4,446,576 | 5/1984 | Hisataka | 2/425 |
| 4,612,672 | 9/1986 | Schrack | 2/411 |
| 5,361,420 | 11/1994 | Dobbs et al. | 2/425 |
| 5,392,468 | 2/1995 | Leddick, III | 2/424 |
| 5,615,419 | 4/1997 | Williams | 2/411 |

*Primary Examiner*—Michael A. Neas
*Attorney, Agent, or Firm*—Wolf, Greenfield & Sacks, P.C.

[57] ABSTRACT

A helmet designed for use in winter sports, particularly the sport of snowboarding, having a flexible ear protection member including a hearing enhancement feature disposed therein is disclosed. The hearing enhancement feature may preferably be formed as an aperture disposed through at least a portion of the ear protection member, and preferably includes a deflection element to deflect objects away from the aperture, thereby preventing objects from passing through the aperture and penetrating the ear protection member in order to protect portions of the user's ear underlying the aperture from injury. The ear protection member may be configured as a ear flap including an abrasion-resistant outer layer to provide protection against branches and the like. In one embodiment, the ear flap may be formed as part of a comfort ring supported by the helmet. The helmet may also include a puncture resistant outer shell, an abrasion resistant inner liner and climate control features, such as vents, to regulate the temperature and air flow within the helmet.

26 Claims, 4 Drawing Sheets

HELMET WITH EAR PROTECTION AND A HEARING ENHANCEMENT FEATURE

DESCRIPTION

1. Technical Field

The present application relates to a helmet designed particularly for use in winter sports, especially the sport of snowboarding, and which includes an ear protection member having a hearing enhancement feature.

2. Background of Related Art

Helmets are utilized in a number of sports to help protect the user from a variety of head injuries, whether the injury is in the form of a puncture, impact, or simple abrasion. Helmets are generally designed for the particular sport and/or activity in which they are intended to be utilized, with the requirements varying from sport to sport. In some sports, such as motorcycling, it is desirable to cover the ears of the user to provide protection to the ears. In other sports, such as cycling, the helmets are extremely lightweight and cover only the top portion of the head, and do not generally cover the ears of the rider. In sports such as skiing and snowboarding, covering the ears of the user is desirable to protect the ears of the user from abrasions as well as the winter climate. However, in such sports it may also be desired to enhance the hearing of the user. For example, in the sport of snowboarding, snowboard riders rely on both their sense of sight and sound when riding in confined areas. In the sport of snowboarding it is known to cover the ears of the user with the hard outer shell of the helmet. When utilizing a hard outer shell to cover the ears, holes are sometimes formed through the shell to communicate with the exterior environment. It is also known to cover the ears of the snowboard rider with an ear flap formed of an abrasion resistant material that can be tucked into the helmet to expose the ears of the user, as desired. Such a helmet including an ear flap is disclosed in pending U.S. patent application Ser. No. 08/780,822, now U.S. Pat. No. 5,915,537, assigned to the Burton Corporation.

SUMMARY

In accordance with the present invention, there is provided a helmet designed for use in winter sports, particularly the sport of snowboarding, having a flexible ear protection member including a hearing enhancement feature disposed therein. The hearing enhancement feature may preferably be formed as an aperture disposed through at least a portion of the ear protection member, and preferably includes a deflection element to deflect objects away from the aperture, thereby preventing objects from passing through the aperture and penetrating the ear protection member in order to protect portions of the user's ear underlying the aperture from injury. The ear protection member may be configured as a ear flap including an abrasion-resistant outer layer to provide protection against branches and the like. In one embodiment, the ear flap may be formed as part of a comfort ring supported by the helmet. The comfort ring may include multiple layers of material, for example, an outer layer to provide abrasion resistance, a second layer to provide cushioning, a third layer to provide protection against the elements such as wind and water, and an inner-layer to draw moisture away from the skin of the user. In such a multilayer configuration, the hearing enhancement feature may be disposed on or between one or more of the multiple layers.

The helmet may also include a puncture resistant outer shell, an abrasion resistant inner liner and climate control features, such as vents, to regulate the temperature and air flow within the helmet.

It is therefore an object of the present invention to provide a helmet having a flexible ear protection member including a hearing enhancement feature disposed therein to increase the hearing of the user through the ear protection member.

BRIEF DESCRIPTION OF THE DRAWINGS

Various embodiments are described herein with reference to the drawings, wherein.

DETAILED DESCRIPTION OF THE EMBODIMENTS

Figure 1:
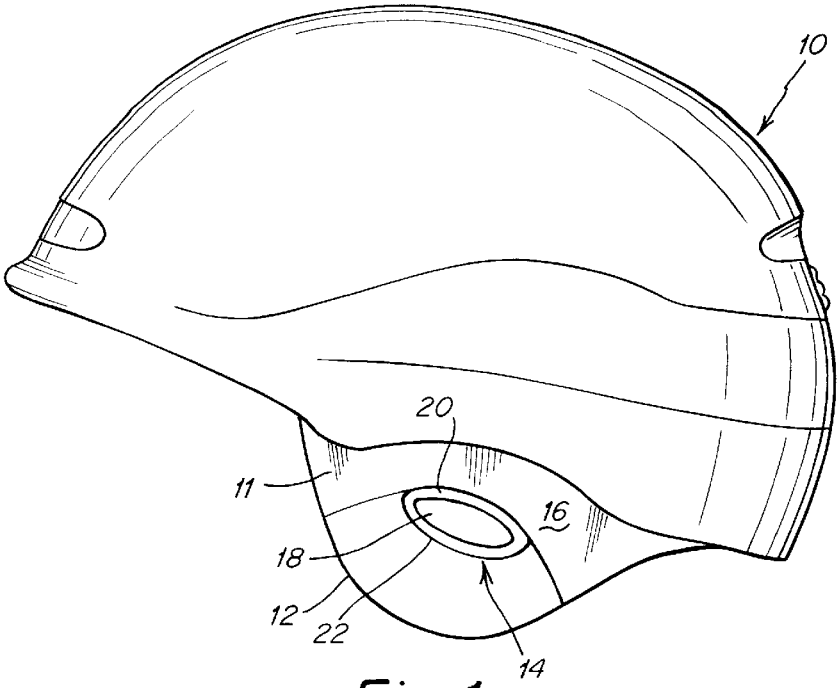
FIG. 1 is a side view of a helmet having flexible, abrasion resistant ear protection member including a hearing enhancement element disposed therein according to the present invention.
Figure 2:
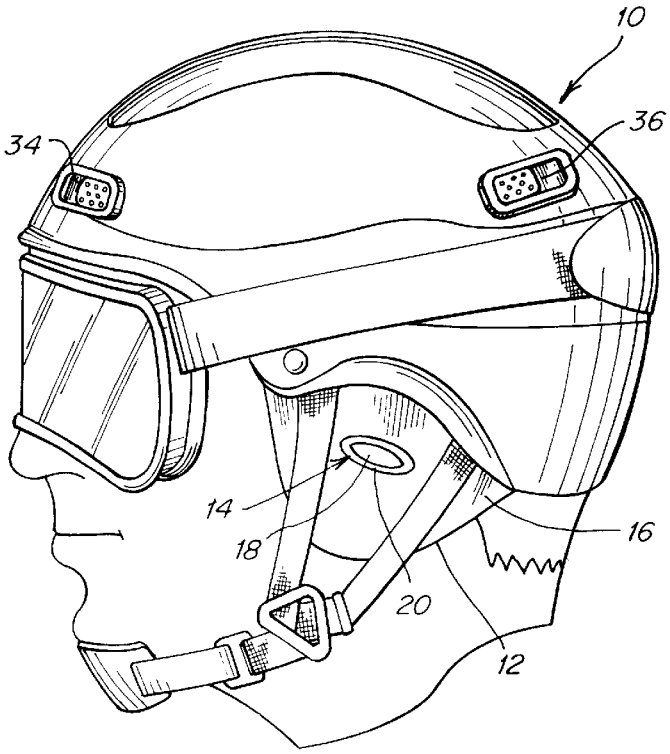
FIG. 2 is a perspective view of the helmet of FIG. 1 worn by a user.

In one embodiment of the invention, shown in FIGS. 1–5, a helmet 10 is provided including an ear protection member 12 having a hearing enhancement feature 14 disposed therein. Helmet 10 may preferably be designed for use in the sport of snowboarding, although it may have applications in other sports, for example, skiing. Ear protection member 12 may be supported by helmet 10 and includes a body portion 11 designed to overlay a portions of the user's ear. The ear protection member may preferably be configured as a flexible ear flap having an abrasion resistant outer layer 16 to protect underlying portions of the user's ear from abrasions from branches and the like, and also includes hearing enhancement feature 14 disposed therein. Hearing enhancement feature 14 includes an aperture 18 disposed through at least a portion of ear flap 12, and may also preferably include a deflection element 20 supported by the ear flap. Aperture 18 effectively reduces the thickness of flap 12 by removing material from portions of the flap so that sound which may not otherwise pass through ear flap 12 can pass through the reduced thickness portion of the flap defined by aperture 18. Ear flap 12 may be made from multiple layers and aperture 18 may be formed through one or more layers of flap 12 (as described below), and may also be preferably formed through at least the abrasion-resistant outer layer 16. Aperture 18 may be centrally disposed through flap 12 so as to overlay the middle, or concha, portion of the user's ear and may also have a generally oval shape, as shown in FIG. 1. In the present embodiment, aperture 18 has a length, l, of about 2.5 inches and a width, w, of about 1 inch. Alternately, the aperture may be disposed anywhere on ear flap 12, may be any shape (for example, round, rectangular or irregular), and may be any size smaller than flap 12, as would be known to one of skill in the art.

Figure 4:
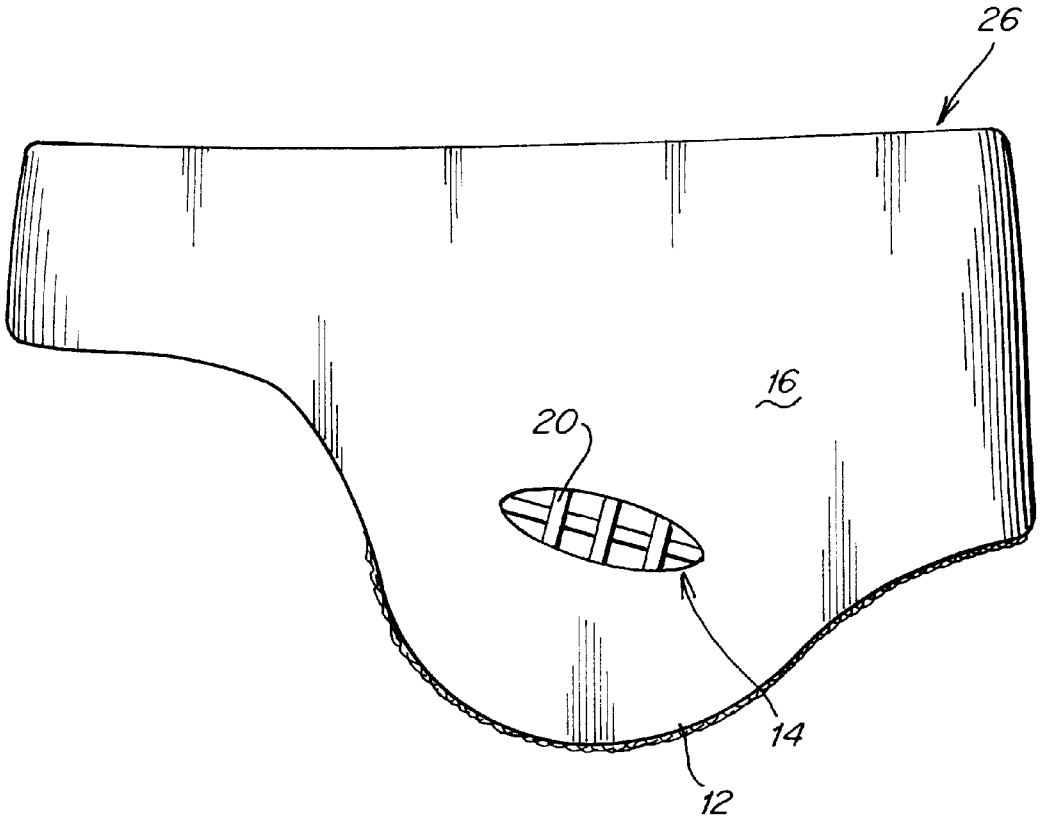
FIG. 4 is a side view of a comfort ring for use with the helmet of FIG. 1.
Figure 6:
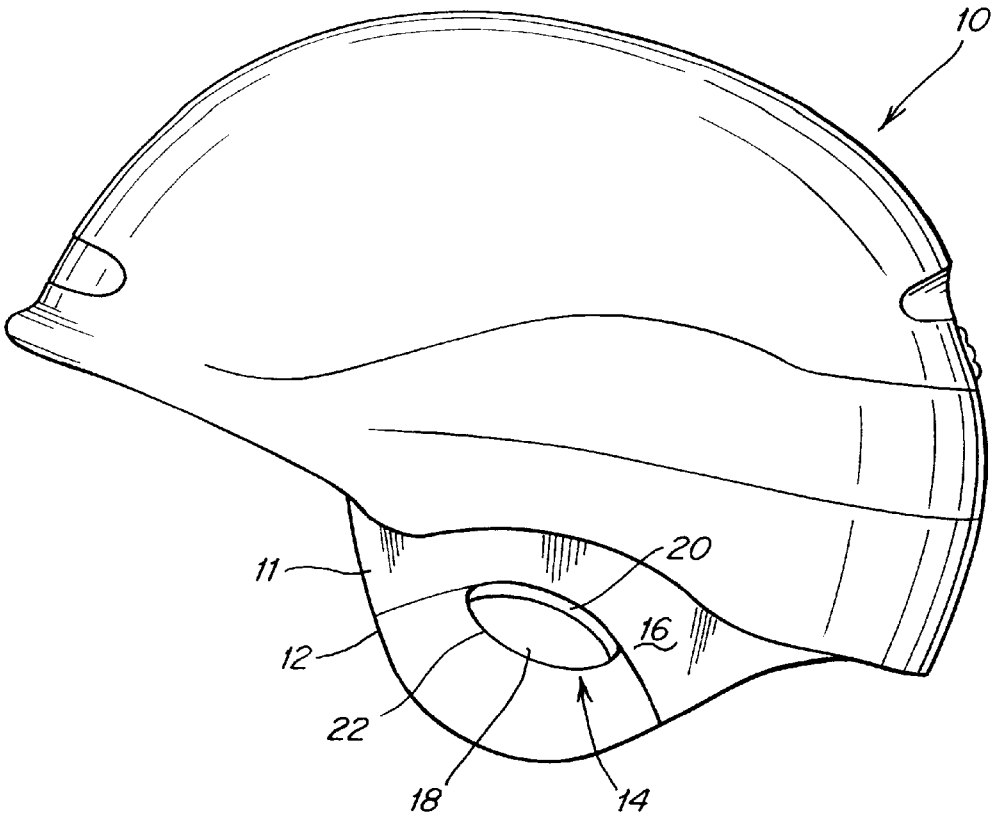
FIG. 6 is a side view of a helmet illustrating an alternative embodiment of a deflection element partially disposed around the perimeter of a hearing enhancement aperture.

The deflection element 20 is configured to deflect objects away from aperture 18 to prevent penetration by the objects through the aperture in order to protect portions of the user's ear underlying the aperture. As shown in FIG. 1, the deflection element 20 may be disposed entirely around the perimeter 22 of aperture 18. Alternately, the deflection element may be only partially disposed around the aperture, for example around the top portion only (FIG. 6) or the deflection element may extend across or partially across the aperture (for example a baffle or mesh as shown in FIG. 4). The shape of deflection element 20 preferably is configured to follow the contours of perimeter 22. In the present embodiment the deflection element 20 is disposed through aperture 18, adjacent perimeter 22 and is secured to the underside of the abrasion-resistant outer layer 16 by stitching. Alternately, the deflection element can be disposed on the outer surface of the layer 16, and may be secured to flap 12 in any suitable manner (for ex. adhesive), as would be known in the art. The deflection element 20 preferably has a rigidity greater than flap 12 and may preferably be formed of a semi-rigid or rigid material, such as polyethylene to provide the desired deflection characteristics. Deflection element 20 may also preferably be raised with respect to outer layer 16 so as to extend above the outer layer, and may be tapered upwardly from side walls of the deflection element, to a top surface of the deflection element.

Figure 3:
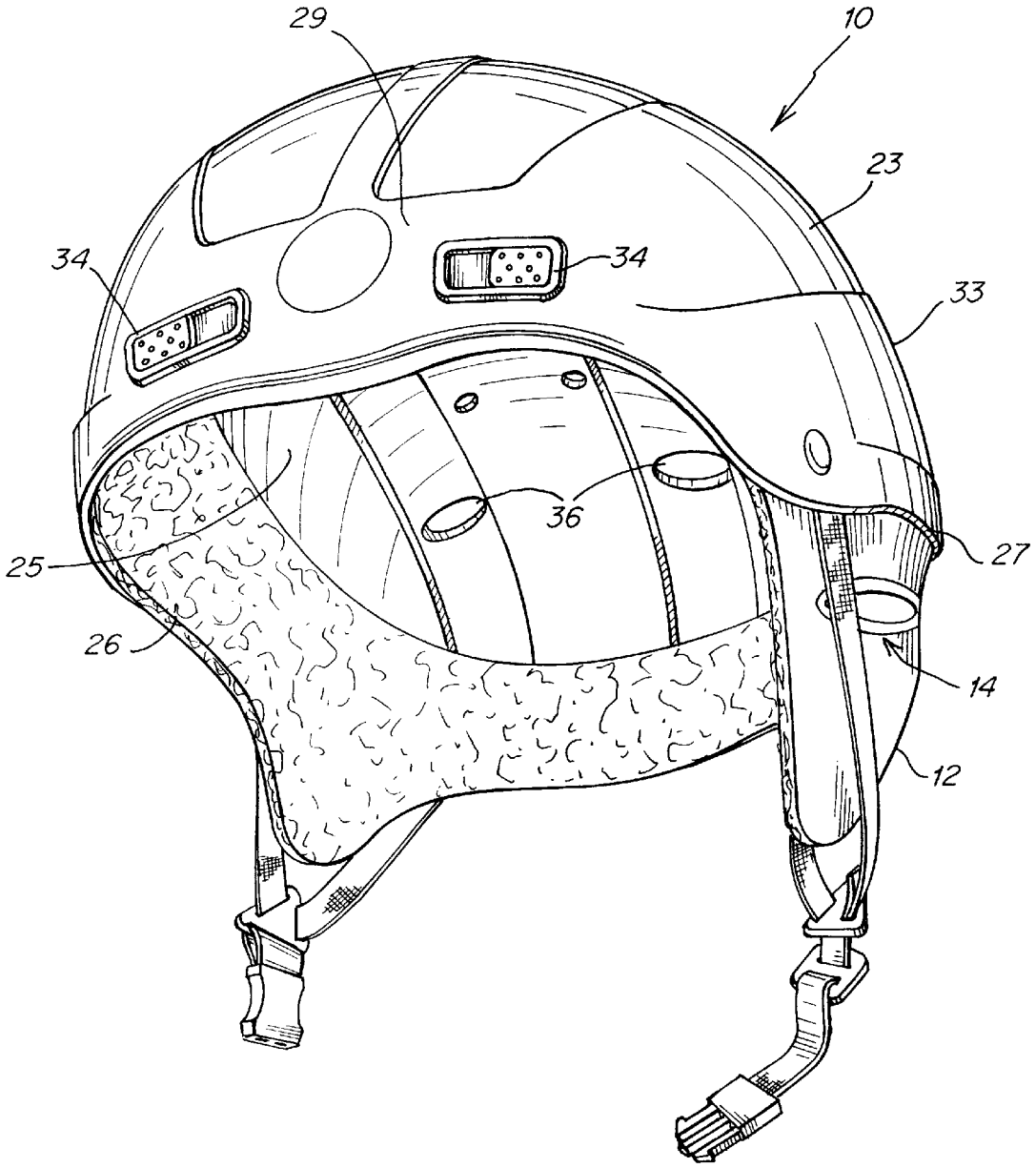
FIG. 3 is front perspective view of the helmet of FIG. 1.
Figure 5:
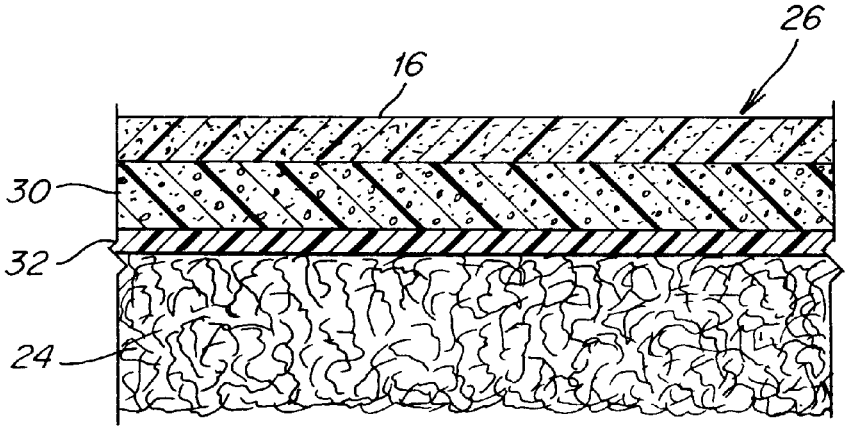
FIG. 5 is a cross-section of the comfort ring of FIG. 4.

Helmet 10 may also include an outer shell 23, a liner 25, and a comfort ring 26, as shown in FIG. 3. Ear flap 12 may be formed as a unitary part of comfort ring 26, or may alternately be a separate member. In the present embodiment, comfort ring 26 may include multiple layers of material to provide abrasion resistance from branches and the like over areas where the comfort ring extends beyond the shell of the helmet, to actively contribute to the climate control of helmet 10, and to preferably increase the comfort of helmet 10 when worn. The multiple layers of material may include, for example, the abrasion resistant outer layer 16, a cushioning second layer 30 for providing padding for comfort, a weather-resistant third layer 32 for providing protection against wind and moisture, and a soft liner, or inner layer 24 which may include wicking capabilities so as to draw moisture away from the skin of the wearer (FIG. 5). If all of the qualities provided by the multiple layers of material are not needed, or desired, any combination of the multiple layers may be utilized. Aperture 18 of hearing enhancement feature 14 may be disposed through one, some, or all of the multiple layers, as desired. In the present embodiment the aperture is disposed through outer layer 16 cushioning layer 30 and third layer 32, while no material is removed from the inner layer, and the deflection element 20 is secured between the outer layer 18 and inner layer 24.

Outer shell 23 of helmet 10 is designed to be puncture resistance and is preferably fabricated from a lightweight material such as nylon, ABS or a composite material, although other materials or combination of materials will be known to one of skill in the art. Outer shell 23 may preferably be contoured and include, for example, a contoured ear portion 27 (FIG. 3) to fit above the ears of the user. Liner 25 may preferably be contoured and dimensioned to fit snugly within shell 23, the liner preferably including an outer surface contacting at least a portion of shell 23 and an inner surface dimensioned and configured to fit over the head of a user. Liner 25 may preferably be made of a lightweight, multiple-impact absorbing material so as to be comfortable to wear while being capable of withstanding more than one impact before requiring replacement, if replacement is required at all. In the present embodiment, liner 25 is preferably formed of an expanded polypropelene material, although other lightweight, multiple-impact absorbing materials will be known to one of skill in the art.

Helmet 10 also includes a frontal portion 29, for placement over the forehead of a user, and a rear portion 33, for placement over the back of a user's head. Helmet 10 may be configured to fit snugly and comfortably over the head of a variety of users, and as such may come in a variety of sizes ranging from youth sizes through adult. Helmet 10 may be a hard-shell, impact absorbing helmet which preferably provides a user with resistance to head injury due to impact, puncture, and abrasions, when properly utilized. In the present embodiment, the helmet may be utilized in a cold weather environment, and therefore should preferably not crack or otherwise mechanically degrade in extreme temperatures or in extreme weather conditions, for example rain, sleet and snow. In addition, helmet 10 may preferably not only provide the user with protection from head injury, but may also provide the user with protection against the cold and include climate control features to preferably regulate the temperature, air flow and moisture within the helmet 10. Such climate control features may include, for example, front and rear vents 34 and 36, respectively, which may allow a user to selectively adjust airflow through the helmet, and may also include comfort ring 26 for preferably helping to prevent and remove moisture from contact with the skin of the user, as described above. A helmet including such climate control features is described in U.S. Pat. No. 5,915,537 assigned to the Burton Corporation, which is incorporated herein by reference.

It will be understood that various modifications may be made to the embodiment disclosed herein. For example, the ear protection member and hearing enhancement feature may be utilized with other style helmets, other than the helmet described herein. Therefore, the above description should not be construed as limiting, but merely as exemplifications of a preferred embodiment. Those skilled in the art will envision other modifications within the scope spirit of the invention.

I claim:

1. A helmet with hearing enhancement for providing protection to an alpine sport user, comprising:

a hard, puncture resistant outer shell contoured to fit above the ears of the user;

a flexible, ear protection member supported by said outer shell and having a body portion constructed and arranged to cover a portion of the ears of the user; and an aperture disposed only partially through said body portion to increase the ability of the user to hear when wearing the helmet.

2. The helmet according to claim 1, further comprising a deflection element supported by said ear protection member and constructed and arranged to deflect objects away from said aperture.

3. The helmet according to claim 1, wherein said ear protection member includes an abrasion resistant outer layer.

4. The helmet according to claim 1, wherein said ear protection member is configured as a flap.

5. The helmet according to claim 1, wherein said ear protection member is formed as part of a comfort ring supported by said helmet.

6. The helmet according to claim 5, wherein said ear protection member includes more than one layer.

7. The helmet according to claim 6, wherein said aperture is disposed through one of said layers.

8. The helmet according to claim 6, wherein said aperture is disposed through at least two of said layers.

9. The helmet according to claim 2, wherein said deflection element is disposed entirely around a perimeter defined by said aperture.

10. The helmet according to claim 2, wherein said deflection element is disposed within said aperture.

11. The helmet according to claim 2, wherein said deflection element is rigid.

12. The helmet according to claim 2, wherein said deflection element is raised relative to said body of said ear protection member.

13. A helmet with hearing enhancement for providing protection to an alpine sport user, comprising:

a hard, puncture resistant outer shell contoured to fit above the ears of the user;

a flexible, ear protection member supported by said outer shell and having a body portion constructed and arranged to cover a portion of the ears of the user;

an aperture disposed at least partially through said body portion to increase the ability of the user to hear when wearing the helmet; and a deflection element supported by said ear protection member and constructed and arranged to deflect objects away from said aperture, wherein said deflection element is disposed partially around a perimeter defined by said aperture.

14. A helmet with hearing enhancement for providing protection to an alpine sport user, comprising:

a hard, puncture resistant outer shell contoured to fit above the ears of the user;

a flexible, ear protection member supported by said outer shell and having a body portion constructed and arranged to cover a portion of the ears of the user;

a hearing enhancement member supported by said body portion; and a deflection element supported by said ear protection member and constructed and arranged to deflect objects away from said hearing enhancement member.

15. The helmet according to claim 14, wherein said hearing enhancement member is an aperture disposed at least partially through said body portion to increase the ability of the user to hear when wearing the helmet.

16. The helmet according to claim 15, wherein said deflection element is disposed entirely around a perimeter defined by said aperture.

17. The helmet according to claim 15, wherein said deflection element is disposed partially around a perimeter defined by said aperture.

18. The helmet according to claim 15, wherein said deflection element is raised relative to said body of said ear protection member.

19. The helmet according to claim 15, wherein said aperture is disposed only partially through said body portion.

20. The helmet according to claim 14, wherein said ear protection member includes an abrasion resistant outer layer.

21. The helmet according to claim 14, wherein said ear protection member is configured as a flap.

22. The helmet according to claim 14, wherein said ear protection member is formed as part of a comfort ring supported by said helmet.

23. The helmet according to claim 14, wherein said ear protection member includes more than one layer.

24. The helmet according to claim 23, wherein said deflection element is disposed between said more than one layer.

25. The helmet according to claim 23, wherein said aperture is disposed through one of said layers.

26. The helmet according to claim 23, wherein said aperture is disposed through two or more of said layers.

* * * * *